US005201483A

United States Patent [19]

Sutnar et al.

[11] Patent Number: 5,201,483

[45] Date of Patent: Apr. 13, 1993

[54] PROCESS AND SYSTEM FOR MEASURING AXLE AND BEARING TEMPERATURES

[75] Inventors: Ivan Sutnar, Leoben; Wolfgang Nayer, Zweltweg, both of Austria

[73] Assignee: Voest-Alpine Eisenbahnsysteme Gesellschaft m.b.H., Vienna, Austria

[21] Appl. No.: 703,260

[22] Filed: May 20, 1991

[30] Foreign Application Priority Data

May 18, 1990 [AT] Austria ..... 1114/90

[51] Int. Cl.[5] ..... B61L 3/06

[52] U.S. Cl. ..... 246/169 A; 246/DIG. 2

[58] Field of Search ..... 246/DIG. 2, 167 R, 169 R, 246/169 A, 169 D

[56] References Cited

U.S. PATENT DOCUMENTS

| | | | |
|---|---|---|---|
| 3,402,290 | 9/1968 | Blackstone et al. | 246/169 D |
| 3,513,462 | 5/1970 | Blakeney et al. | 246/169 A |
| 3,731,087 | 5/1973 | King | 246/169 D |
| 4,113,211 | 9/1978 | Glazar | 246/169 A |
| 4,323,211 | 4/1982 | Bambara et al. | 246/169 A |
| 4,659,043 | 4/1987 | Gallagher | 246/169 D X |
| 4,805,854 | 2/1989 | Howell | 246/169 D |
| 4,853,541 | 8/1989 | Duhrkoop | 246/169 D X |
| 4,878,761 | 11/1989 | Duhrkoop | 246/169 D X |
| 4,928,910 | 5/1990 | Utterback et al. | 246/169 A |
| 5,060,890 | 10/1991 | Utterback et al. | 246/169 A |

FOREIGN PATENT DOCUMENTS

| | | |
|---|---|---|
| 263896 | 10/1986 | European Pat. Off. . |
| 276201 | 1/1988 | European Pat. Off. . |
| 263217 | 4/1988 | European Pat. Off. . |
| 3027935 | 2/1981 | Fed. Rep. of Germany . |
| 3111297 | 2/1982 | Fed. Rep. of Germany . |

*Primary Examiner*—Michael S. Huppert
*Assistant Examiner*—Scott L. Lowe
*Attorney, Agent, or Firm*—Cushman, Darby & Cushman

[57] ABSTRACT

In a process for measuring axle bearing temperatures in order to locate hot wheels in moving railroad cars with infrared receivers and with an oscillating scanning beam that is oriented transversely to the longitudinal direction of the rail, the analog measured values from the infrared receiver are digitized and then coupled with the oscillation frequency orientation of the scanning beam so that at least two complete oscillations of the scanning beam are analyzed for each axle. A mean value is formed from the measured value corresponding to one sub-area of a first oscillation of the scanning beam and from the measured value that corresponds to subsequent oscillations of the scanning beam. When this is done, the calculation of the average or mean value is repeated for a specific predetermined maximum number of oscillations of the scanning beam and for as long as an activation signal initiated by the wheel signals from the same axle is within the measuring angle of the center. For each calculation, the highest mean value of the measured values of corresponding sub-areas is evaluated.

16 Claims, 3 Drawing Sheets

PROCESS AND SYSTEM FOR MEASURING AXLE AND BEARING TEMPERATURES

BACKGROUND OF THE INVENTION

1. Field of the Invention

The present invention relates to a process for measuring axle or bearing temperatures in order to identify the wheels of railway rolling stocks that are running hot. This invention incorporates infrared temperature receivers and an oscillator that is oriented transversely to the longitudinal direction of the rails, the measured analog values from the infrared receiver being digitized.

2. Description of Related Art

A number of systems for measuring impermissible temperature increases (and in particular for the identification of railway rolling stock wheels that are running hot) are already known. The measuring system itself includes an infrared temperature receiver which is usually located close to the rails so that an active window that subtends an angle to the normal can detect the bearings of a moving railroad car. Only a relatively short period of time is available for temperature measurement, particularly at higher speeds, and rolling stock moving in the longitudinal direction of the rails deviates from rectilinear movement if a straight track has been shifted. This so called "sinusoidal path" leads to a lateral displacement of the axles that having a magnitude on the order of ±4 cm. Depending on the design of the bearing, and in particular, the design of the bearing cover, the hottest point that is measurable in a particular bearing design is located at different points. In order to be able to detect all of these deviations of the hottest point of an axle or a bearing transversely to the longitudinal direction of the rails, systems with which a larger area can be detected transversely to the longitudinal direction of the rails have already been proposed in order to be able to detect that particular area of a bearing that is actually too hot, and to be able to do this in a reliable manner. Given an appropriately wide scanning beam transverse to the longitudinal direction of the rail, an integrated signal is obtained which contains the hottest point with certainty. However, the integration that is provided by the detection of a relatively wide area in the longitudinal direction of the axles leads overall to a relatively small difference of the signals that are measured, so that reliable analysis is not possible without some difficulty. In particular, in the case of relatively complete bearing covers, impermissible heating can only be detected over a small part of the axial length of an axle since, by comparison, the other areas are significantly cooler.

In order to widen the possible scanned section along the axis of a bearing, systems that use rotating and oscillating mirrors have been proposed. When these are used, the heating or infrared radiation that occurs along the axle of a railroad car is directed onto an infrared detector and focused. EP-A 265 417 has already proposed the incorporation of a system to widen the image at least on one axis in order to detect overheated wheel bearings in the beam path from the measurement point to the thermal radiation sensor. A system of this kind is formed from a distorting optical element that permits the representation of a correspondingly widened field. Systems that incorporate an oscillating deflection system are described, for example, in EP-A 264 360. On the system, measurement accuracy could be increased since the amplitude of the oscillation of the deflection system has been so selected that a reflection of the cooled detector is picked up at regular intervals by itself in order to arrive at one calibration point for increasing measurement accuracy by this means.

SUMMARY OF THE INVENTION

It is the aim of the present invention to so develop a process of the type described in the introduction hereto, which incorporates an oscillating scanning beam, so that given different configurations of bearings and different positions of the hottest point of a bearing in the longitudinal direction of the axle can be assigned a significant value. In order to solve this problem, the process according to the present invention comprises steps where the measured values of the infrared temperature receiver are coupled with the oscillating frequency of orientation of the scanning beam, in that at least two complete oscillations of the scanning beam are analyzed for each axle; an average value is formed from a measured value that corresponds to one partial area of a first oscillation of the scanning beam and from the measured values that correspond to the corresponding part area of subsequent oscillations of the scanning beam; the calculation of the main value is repeated through a predetermined maximum number of oscillations of the scanning beam and/or until a further signal that is initiated by the wheel signals the identical axle in the measurement angle of the sensor; and the highest mean value of the measured values of the corresponding partial areas is analyzed. Since the measured values from the infrared receiver, in particular, measure voltage values are digitized, it is a simple matter to couple values of this kind with the oscillation frequency of the oscillating scanning beam, whereby measured values that are classified for the particular orientation of the scanning beam are made available. Given correspondingly high oscillation frequencies, the same axle can be scanned several times even in the case of rolling stock that is moving at high speed, and because of the fact that at least two complete oscillations of the scanning beam can be analyzed per axle it is possible to arrive at a mean value from which, by coupling with the oscillation frequency or the orientation of the scanning beam, it is known which areas of the axle the particular signals correspond to which will eliminate further interference. To this end, according to the present invention, a means value is calculated from a measured value that corresponds to one sub-area of a first oscillation of the scanning beam and from at least one additional value from the corresponding sub-area of a further oscillation of the scanning beam, so that the number of average values generated in the case of rail traffic that is moving correspondingly slower can be limited, since no higher level of accuracy will be insured by taking additional measured values into consideration and the process will be interrupted when the particular axle that is being measured leaves the angle of measurement of the sensor. In order to ascertain whether or not the same axle is still located within the measurement angle of the sensor, a signal that is initiated by the wheel will be evaluated, so that this signal can originate from a conventional wheel sensor. With measurements of this sort, repeated measurement of the hottest point will result in a relatively significant peak which actually represents a significant value for the excessive bearing or axle heating and, for this reason, according to the present invention, the highest mean value of the measured values of corresponding sub-areas will be used for analysis.

In order to cope with speeds of moving rolling stock of up to 300 km/h whilst ensuring that at least two complete oscillations can be analyzed, it is advantageous to select the oscillation frequency of the scanning beam to be between 2 and 10 kHz. In order to prevent the fact that since only integral signals with a corresponding lack of definition are used for analysis, a correspondingly high sampling rate must be selected; thus, it is advantageous that the scanning rate is equal to an integer multiple of the oscillation frequency, and in particular equal to 5 to 15 times the oscillation frequency. In this way, it is ensured that each complete oscillation of the scanning beam can be divided into 5 to 15 sub-areas, when the measured values of such sub-areas can in each case be used to form an average value with corresponding measured values from the corresponding sub-areas from at least one additional oscillation. In order to provide adequate protection for the mechanical components of the infrared temperature receiver, it is advantageous that the process be such that the oscillating movement of the scanning beam is switched on by a wheel sensor that precedes the point of measurement and then switched off once the last wheel has passed this sensor.

In the case of strong sunlight, the unilateral heating of bearings that this can cause can result in a distortion of the results obtained by measurement. In order preclude distortion of the measured results of this kind and to retain significant measured values, it is advantageous that the means values of the measurement values obtained from the same axle on both sides of the car be compared to each other; thus, it is advantageous that the mean values of the measured values obtained from axles that follow each other in sequence in the longitudinal direction of the car be compared to each other as well. Calculation of the mean values of the measured values from the same axle on the left and right hand sides of the car provides information as to whether the sun striking one side of the car has distorted the results that have been obtained. Comparison of the measured values obtained from axles that follow each other in sequence on the same side of the car can be analyzed on the basis of probability considerations, since an excessive number of hot wheels on one side is an improbable event.

In order to arrive at significant and meaningful measured values for mean values of measured values, it is advantageous that the process be carried out as such that at least 3 and at most 20 measured values of sub-areas of the oscillation of the scanning beam are used to form a mean value. In order to signal the fact that the same axle is still in the measurement angle of the sensor, it is advantageous that at least one wheel sensor is arranged on the rail adjacent to the infrared receiver, so that the oscillatory movement of the scanning beam can be switched on at least one wheel sensor that is arranged so as to be offset in the longitudinal direction of the rails. In the event that traffic alternates tracks, or in the case of single track operation, when traffic moves in both directions on the same track, a separate wheel sensor will have to be installed displaced in the longitudinal direction so as to be ahead of and behind the infrared temperature receiver.

BRIEF DESCRIPTION OF THE DRAWINGS

The present invention will be explained in greater detail below on the basis of an embodiment shown in the drawings appended hereto. These drawings show the following.

DETAILED DESCRIPTION OF THE PRESENTLY PREFERRED EXEMPLARY EMBODIMENTS

Figure 1:
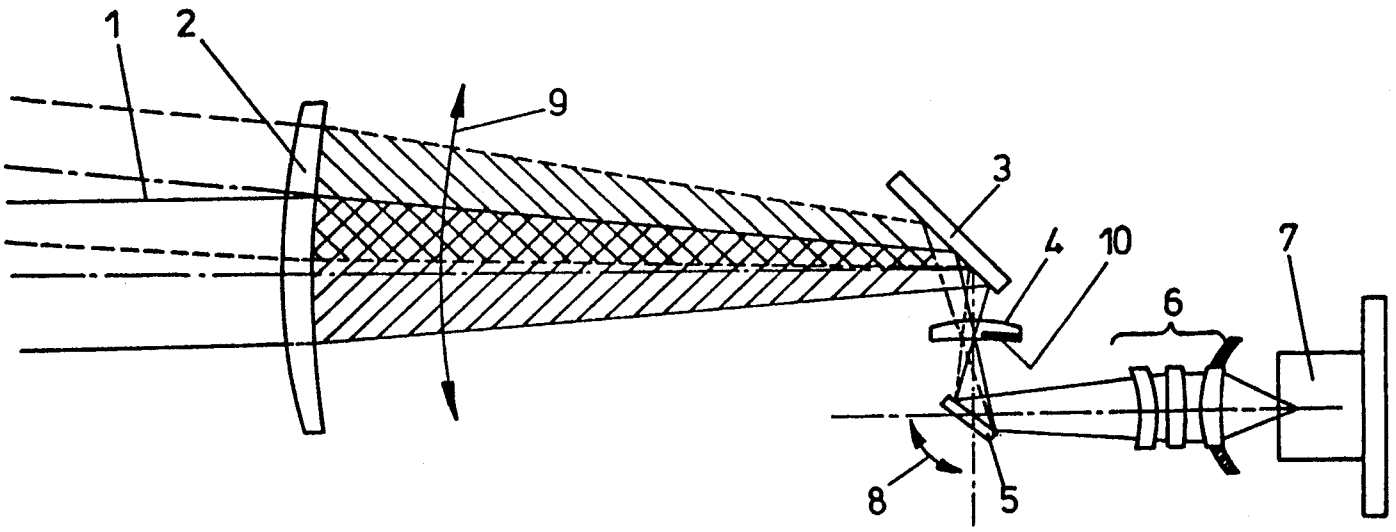
FIG. 1 is a schematic diagram of a infrared temperature receiver with an oscillating mirror.

In the configuration shown in FIG. 1, the measurement beam or scanning beam 1 passes through a focusing optical element 2 and falls on to a beam deflecting mirror 3 and then passes in sequence through an image field lens 4 onto an oscillating mirror 5 that passes the image that is scanned on the image view of lens 4 through an infrared optical system 6 to a detector or thermal radiation sensor 7. The oscillating mirror 5 oscillates as indicated by the double-headed arrow 8 and can be excited to carry out this oscillation either piezoelectrically by means of an oscillating quartz crystal, or electromagnetically.

The image field lens 4 has a radius of curvature on one side that is proximate to the mirror that corresponds to the refractive power of the system lens (ES) within the infrared optical system 6. Because of the oscillatory movement of the mirror 5 on the one hand, an acquisition area that corresponds to the area covered by the double-headed arrow 9 will picked up, and on the other hand, because of the image of the detector 7 that is formed by the system lens of the infrared optical system 6 an appropriate additional deflection passes onto the mirrored area 10 in the edge zone of the system lens. The image of the detector 7 is reflected in these edge areas and thus a reference signal for the temperature of the detector element 7, which can be cooled very simply by thermoelectric means made available in these edge areas. Thus, auto-collimation is achieved by the reflected and damped area of the image field lens 4, which is number 10. Since small images on the surface of the lens caused by possible inhomogeneities are critical, the lens can be arranged somewhat above the point of focus. However, in the present case only a small amount of additional modulation can occur even if there are such inhomogeneities because of the deflected beam, and these additional modulations are insignificant with regard to the formation of the reference.

When the mirror 5 oscillates in the direction indicated by the double-headed arrow 8, a corresponding sub-area will be picked up as a scanned area. Given appropriate knowledge of the oscillation frequency of the oscillating mirror 5, a corresponding sub-area of the oscillation of this oscillating mirror 5 can be associated with the particular position of the scanned area, To this end, an inductive sender unit for the actual oscillating frequency of the mirror 5 (not shown here) can be provided.

Figure 2:
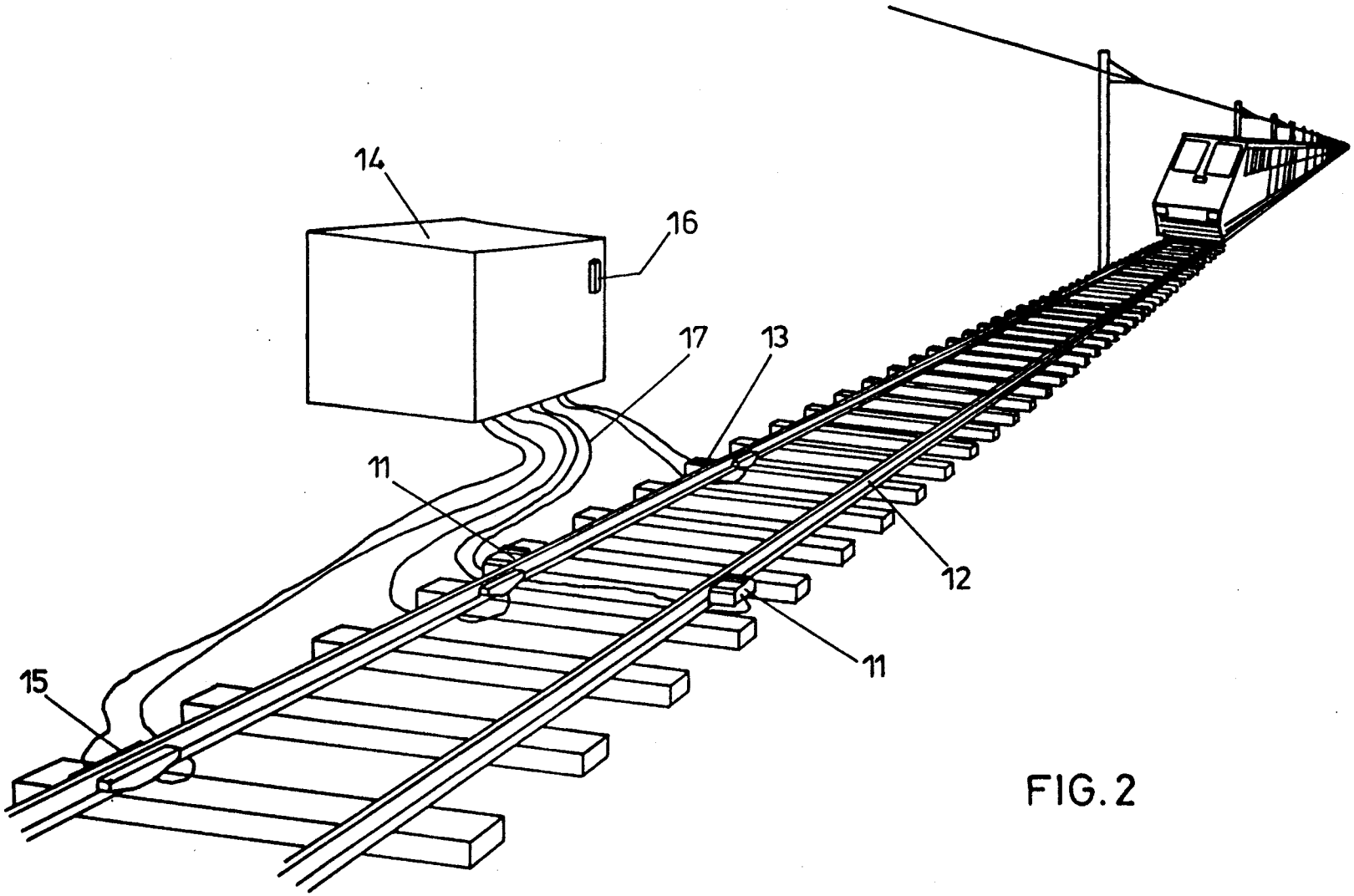
FIG. 2 is a perspective view of the receiver in the track.

FIG. 2 shows a schematic arrangement of an infrared receiver within the rails. The receivers are numbers 11 and there is one receiver for each separate rail 12. In order to permit switching on of the system and the counting of the axles that pass the infrared receiver 11, there is a rail contact 13. The switching of the analysis circuit that is numbered 14, and the oscillation frequency of the oscillating mirror 5 can be affected after the passage of specific period of time after which the last axle has passed the wheel sensor or rail contact 13, respectively. Alternatively, an additional wheel sensor 15 can be provided for this purpose. This additional sensor is then of importance if the rail is to be used in both directions, since the wheel sensor 15 provides the switch-on pulse for the oscillator of the oscillating mirror 5 and for synchronization of the analysis electronics. In addition, the analysis electronics incorporates an outside or air temperature sensor 16 in order to improve the accuracy with which the measured values are acquired. The signals that are provided from the infrared receiver 11 through the signal line 17 to the analysis electronics are now used to form the measured values, as is explained in greater detail in connection with FIG. 3.

Figure 3:
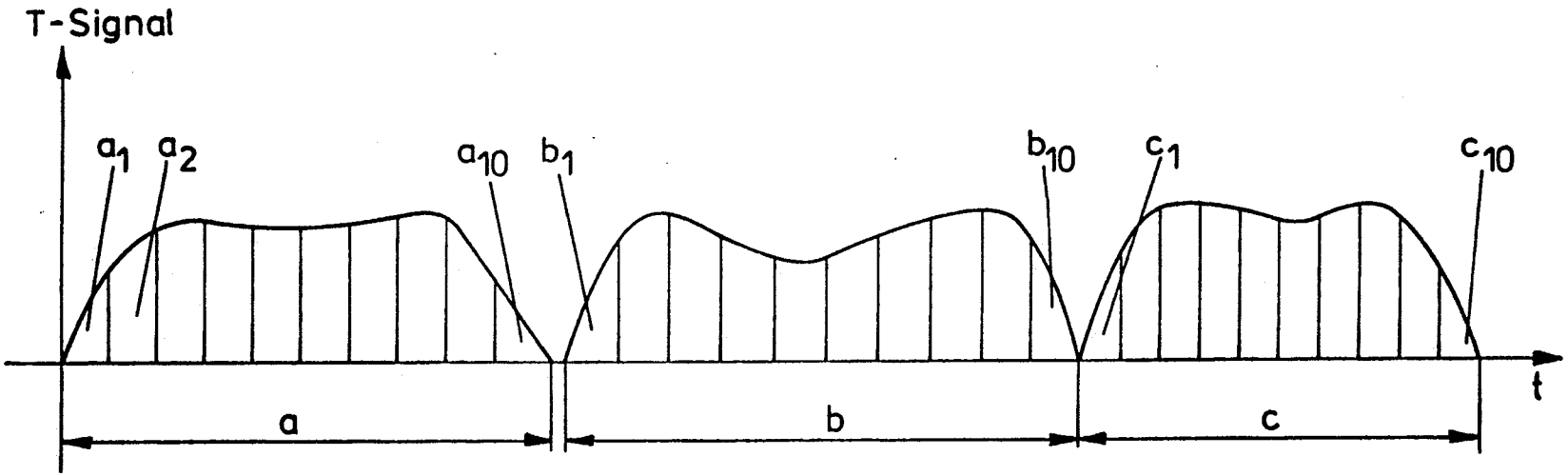
FIG. 3 is a schematic illustration of the generation of measured values from the signals obtained from the infrared receiver.

In FIG. 3, "a", indicates the duration of one complete oscillation of the oscillator for the oscillating mirror 5. The measured values are obtained from this complete oscillation, where the scanning beam successively covers the scanned area as indicated by the double-headed arrow 9 in FIG. 1, and these measured values are then passed to intermediate storage. The measured values resulting from a first complete oscillation "a" are indicated as $a_1$, $a_2$, $a_3$, $a_4$, $a_5$, $a_6$, $a_7$, $a_8$, $a_9$ and $a_{10}$. During a subsequent complete oscillation of the oscillating mirror 5, for which the length "b" is available along the time axis at a similar oscillation frequency, once again 10 measured values $b_1$, $b_2$, $b_3$, $b_4$, $b_5$, $b_6$, $b_7$, $b_8$, $b_9$ and $b_{10}$ are obtained in a similar manner at an identical rate. The same thing applies for a third complete oscillation the duration of which is indicated by "c" and which provides the measured values from $c_1$, $c_2$, $c_3$, $c_4$, $c_5$, $c_6$, $c_7$, $c_8$, $c_9$ and $c_{10}$ at a corresponding scanning rate. A mean value is obtained from each of the measured values obtained in this way which bear identical subscripts when, for instance, a mean value $a1+b1+c1/3$ is formed. In the same way, values for $a2+b2+c2/3$ to $a10+b10+c10/3$ are formed. In each instance, the highest mean value results in a significant value for the actual heating of the hottest spot in the scanned area indicated by the double-headed arrow 9 in FIG. 1, and as a result of such analysis of the results of measurement and the formation of a mean value, it is also possible to ensure a sharp measurement signal if a largely covered bearing has a hot spot only in a relatively small sub-area e.g., on the edge of the bearing cover. In bearings of this kind, analysis of the integral signal would make it possible to recognized absolute heating that is significantly smaller than the formation of a mean effected according to the present invention, which actually makes it possible to identify the hottest area in the scanned area.

Of course, the scanning rates can be varied analogously, and it is advantageous to select an integer multiple of the oscillation frequency and, as in a preferred embodiment of the invention, a multiple 5 to 15 times the oscillation frequency.

What is claimed is:

1. A method for measuring axial and bearing temperatures to locate hot wheels in a vehicle adapted for traveling on a rail by using an infrared receiver with an oscillating scanning beam oriented transverse to a longitudinal direction of the rail, said process comprising the steps of:

measuring a wheel element temperature with said infrared receiver to obtain at least two sets of measured values, each value in said at least two sets of measured values representing the temperature of a sub-area of said wheel element;

digitizing said at least two sets of measured values to obtain at least two sets of digitized values;

repeating said measuring and digitizing steps over at least one of: a predetermined number of oscillations of said scanning beam; and the duration of a wheel element signal indicative of a given wheel element being within range of said scanning beam; and generating a set of average values wherein each of said average values is equal to the mean of corresponding values in said at least two digitized sets of values;

providing the largest average value of the set of average values as a hot spot indicator;

wherein said measuring step is performed in synchronization with an oscillation frequency of said scanning beam.

2. The method of claim 1, further comprising the steps of:

generating said wheel element signal when a wheel is proximate to a wheel element sensor; and terminating generation of said wheel element signal when said wheel element is no longer proximate to said wheel element sensor;

wherein said wheel element sensor is located ahead of said scanning beam range relative to a direction of movement of said wheel element.

3. The method of claim 1 or 2, further comprising the step of:

comparing sets of average values for a plurality of wheel elements on opposite sides of an axle.

4. The method of claim 1 or 2, further comprising the step of:

comparing sets of average values of wheel elements on sequential axles.

5. The method of claim 1, further comprising the step of:

oscillating said scanning beam at a frequency between approximately 2 and 10 kilohertz.

6. The method of claim 1, said measuring step comprising the step of:

generating said at least two sets of measured values by measuring said temperature of said wheel element with said scanning beam over N oscillations of said scanning beam, where N is an integer not less than 5 and not greater than 10.

7. The method of claim 1, said generating step comprising the step of:

forming each value in said set of average values from the mean of at least 3 but not more than 10 of said corresponding digitized values.

8. The method of claim 1, further comprising the steps of:

generating said wheel element signal when a wheel element is proximate to a first wheel element sensor; and terminating generation of said wheel element signal when said wheel element is proximate to a second sensor.

9. A system for measuring axial and bearing temperatures to locate hot wheels in a vehicle adapted for traveling on a rail by using an infrared receiver with an oscillating scanning beam oriented transverse to a longitudinal direction of the rail, said system comprising:

means for measuring a wheel element temperature with said infrared receiver to obtain at least two sets of measured values, each value in said at least two sets of measured values representing the temperature of a sub-area of said wheel element;

means for digitizing aid at least two sets of measured values to obtain at least two sets of digitized values;

generating means for generating a set of average measured values wherein each of said average measured values is equal to the mean of corresponding values in said at least two sets of digitized values;

repeating means for operating said generating means over at least one of: a predetermined maximum number of oscillations of said scanning beam; and the duration of a wheel element signal indicative of a given wheel element being within range of said scanning beam; and output means for providing the largest average value of the set of average values as a hot spot indicator;

wherein said measuring means operates in synchronization with an oscillation frequency of said scanning beam.

10. The system of claim 9, further comprising:

a wheel element sensor for generating said wheel element signal only when a wheel element is proximate to said sensor;

wherein said wheel element sensor is located ahead of said scanning beam range relative to a direction of movement of said wheel element.

11. The system of claim 9 or 10, further comprising:

means for comparing sets of average values for a plurality of wheel elements on opposite sides of an axle.

12. The system of claim 9 and 10, further comprising:

means for comparing sets of average values of wheel elements on sequential axles.

13. The system of claim 9, further comprising:

means for oscillating said scanning beam at a frequency between approximately 2 and 10 kilohertz.

14. The system of claim 9, wherein said measuring means generates said at least two sets of measured values by scanning an area of said wheel element with said scanning beam over N oscillations of said scanning beam, where N is an integer not less than 5 and not greater than 10.

15. The system of claim 9, wherein said generating means forms each value in said set of average values from the mean of at least three but not more than 10 of said corresponding digitized values.

16. The system of claim 9, further comprising:

a first wheel element sensor for generating said wheel element signal when a wheel element is proximate to said first sensor; and a second wheel sensor for terminating generation of said wheel element signal when a wheel element is proximate to said second sensor.

* * * * *